US007806130B2

(12) United States Patent
Göbel

(10) Patent No.: US 7,806,130 B2
(45) Date of Patent: Oct. 5, 2010

(54) UMBRELLA

(75) Inventor: Eberhard Göbel, Ulm (DE)

(73) Assignee: Erberhard Gobel GmbH & Co, Ulm (DE)

( * ) Notice: Subject to any disclaimer, the term of this patent is extended or adjusted under 35 U.S.C. 154(b) by 126 days.

(21) Appl. No.: 11/998,144

(22) Filed: Nov. 28, 2007

(65) Prior Publication Data

US 2009/0272413 A1 Nov. 5, 2009

(30) Foreign Application Priority Data

Nov. 29, 2006 (DE) ..... 10 2006 056 581

(51) Int. Cl.
*A45B 25/08* (2006.01)

(52) U.S. Cl. ..... 135/28; 135/38; 135/41

(58) Field of Classification Search ..... 135/28, 135/31, 38–42, 98
See application file for complete search history.

(56) References Cited

U.S. PATENT DOCUMENTS

| | | | | |
|---|---|---|---|---|
| 426,454 | A * | 4/1890 | Ledig | 135/39 |
| 3,156,249 | A * | 11/1964 | Biderman | 135/15.1 |
| 3,856,032 | A * | 12/1974 | Schafer | 135/28 |
| 5,088,512 | A * | 2/1992 | Chou et al. | 135/24 |
| 5,740,824 | A * | 4/1998 | Tang | 135/28 |
| 6,571,813 | B2 * | 6/2003 | Lin et al. | 135/28 |
| 6,758,229 | B2 * | 7/2004 | Wang | 135/41 |
| 6,941,960 | B2 * | 9/2005 | Huang | 135/41 |
| 7,204,261 | B1 * | 4/2007 | Wu | 135/28 |
| 2003/0034058 | A1 * | 2/2003 | Wang | 135/15.1 |

FOREIGN PATENT DOCUMENTS

| | | | |
|---|---|---|---|
| DE | 59434 | | 3/1891 |
| DE | 79618 | | 3/1894 |
| DE | 190281 | | 9/1906 |
| DE | 102004001217 | | 8/2005 |
| EP | 493867 | A1 * | 7/1992 |
| GB | 1 032 315 | | 6/1966 |
| GB | 2361638 | A * | 10/2001 |

* cited by examiner

*Primary Examiner*—Winnie Yip
(74) *Attorney, Agent, or Firm*—Andrew Wilford

(57) ABSTRACT

An umbrella comprising an umbrella shaft (1) and an umbrella frame situated on the umbrella shaft (1), the frame comprising a spider that is formed by umbrella ribs and supports a canopy, and spreader struts that are pivoted on the umbrella ribs and on a slider (2) that is supported so as to be longitudinally displaceable on the umbrella shaft (1) between a closed position and an open position of the umbrella frame. The slider (2) has at least two locking elements (3), each provided for engagement in a lock seat (4) associated with the umbrella shaft in the particular end position of the slider (2), and a handle (5) that is axially displaceable between two end positions is provided on the slider (2). The handle is forcibly entrained from one end position to the other when the slider is actuated, and the locking element (3) that is engaged is shifted to an unlocked state and the other locking element (3) is shifted to a locked state that allows engagement in the other lock seat (4).

10 Claims, 3 Drawing Sheets

UMBRELLA

FIELD OF THE INVENTION

The invention relates to an umbrella comprising an umbrella shaft and an umbrella frame situated on the umbrella shaft, the frame comprising a spider that is formed by umbrella ribs supporting a canopy, and spreader struts that are pivoted on the umbrella ribs and on a slider that is supported so as to be longitudinally displaceable on the umbrella shaft between a closed position and an open position of the umbrella frame.

BACKGROUND OF THE INVENTION

Such umbrellas are widespread in practice, and are used for various purposes such as protection from sun or rain. The decision to purchase a quality, in particular high-quality, umbrella depends not only on the materials used, the weight, and the workmanship, but also on the practical benefit of such an umbrella.

OBJECT OF THE INVENTION

The object of the invention, therefore, is to design an umbrella of the above-described type in such a way that it can be handled in a particularly convenient and easy manner, and at the same time ensures a high degree of operational reliability.

SUMMARY OF THE INVENTION

This object is achieved by means of an umbrella of the above-described type by the fact that the slider has at least two locking elements, each provided for engagement in a lock seat on the umbrella shaft in a respective end position of the slider, and a handle that is axially displaceable between two end positions is provided on the slider, the handle being forcibly entrained from one end position to the other when the slider is actuated, and the locking element that is engaged being shifted to an unlocked state and the other locking element being shifted to a locked state that allows engagement in the other lock seat.

Use of an umbrella having such a design has the advantage that the unlocking of the locking element that is necessary for opening or closing the umbrella is achieved solely by actuating the slider, resulting in particularly convenient and simple use with high operational reliability of the product without the risk of pinching the user's fingers.

It is very particularly preferred when the locking element has a first surface that is inclined relative to the longitudinal axis of the umbrella shaft and that engages against a surface of the lock seat when the slider is actuated and the locking element is in the engaged position and in the unlocked state, thus allowing the locking element to be moved from the engaged position in a radial direction relative to the umbrella axis. This design simplifies moving the locking element from the engaged position solely by adjusting the slider and with no further action by the user, thus allowing the slider to be moved to the other end position.

Within the scope of the invention it is also very particularly preferred when the locking element has a second surface that is inclined relative to the longitudinal axis of the umbrella shaft and engages against a surface of the lock seat as the slider approaches the respective lock seat, so that an elastic deformation of the locking element in the locked state directed radially outward relative to the longitudinal axis of the umbrella shaft, followed by elastic return, allows the locking element to engage in the lock seat. This design ensures that the locking element may be easily brought into the engaged position when it reaches the particular end position of the slider, without further action by the user.

Within the scope of the invention it is also particularly preferred for each lock seat to be formed by a locking sleeve coaxially fixed on the umbrella shaft, the lock seat having a finger-shaped longitudinal section having a transverse groove resting against the umbrella shaft parallel to the longitudinal axis thereof. The associated advantage is that the lock seat may be fixedly mounted in a very easy manner on the umbrella shaft in the particular end position of the slider, using connecting elements or adhesive, and also that a very exact alignment relative to the respective associated locking element is made possible.

It has been shown to be very particularly advantageous for each locking sleeve to have three finger-shaped longitudinal sections uniformly spaced on the umbrella shaft, and for the slider to have six locking elements, where in each case three coact with one of the locking sleeves, and by use of the handle may all be shifted between the locked and unlocked state.

Particularly convenient and simple operation may be achieved by designing the handle as a sleeve that is coaxially nonrotatably mounted on the slider. In this manner operation of the handle and of the slider is independent of the positioning of the individual fingers of the user's hand.

It is further preferred when the handle has at least one shoulder that is brought into contact with a shoulder formed by the slider when the handle reaches the end position of its travel.

Furthermore, it is very particularly advantageous when a locking member is provided for detachably securing the handle in its particular end position, and the handle is protected from being pulled off the slider. This effectively prevents inadvertent displacement of the handle, which might occur as a result of the umbrella being dropped, for example. It has been shown to be sufficient for the locking member to be designed as an offset and elastically deformable tongue provided on the inner side of the handle facing the slider, the offset area and/or end face of the tongue being provided for bearing against a catch situated on the outer peripheral surface of the slider.

Within the scope of the invention it is further preferred for the slider to have skids on the side facing the umbrella shaft, thus allowing the slider to be displaced over the lock seat.

With regard to particularly simple manufacture and installation of the handle, it has been shown to be advantageous for the handle to have a multipart design.

BRIEF DESCRIPTION OF THE DRAWING

The invention is explained in greater detail below with reference to one illustrated embodiment illustrated in the drawings, in which.

SPECIFIC DESCRIPTION

Figure 1A:
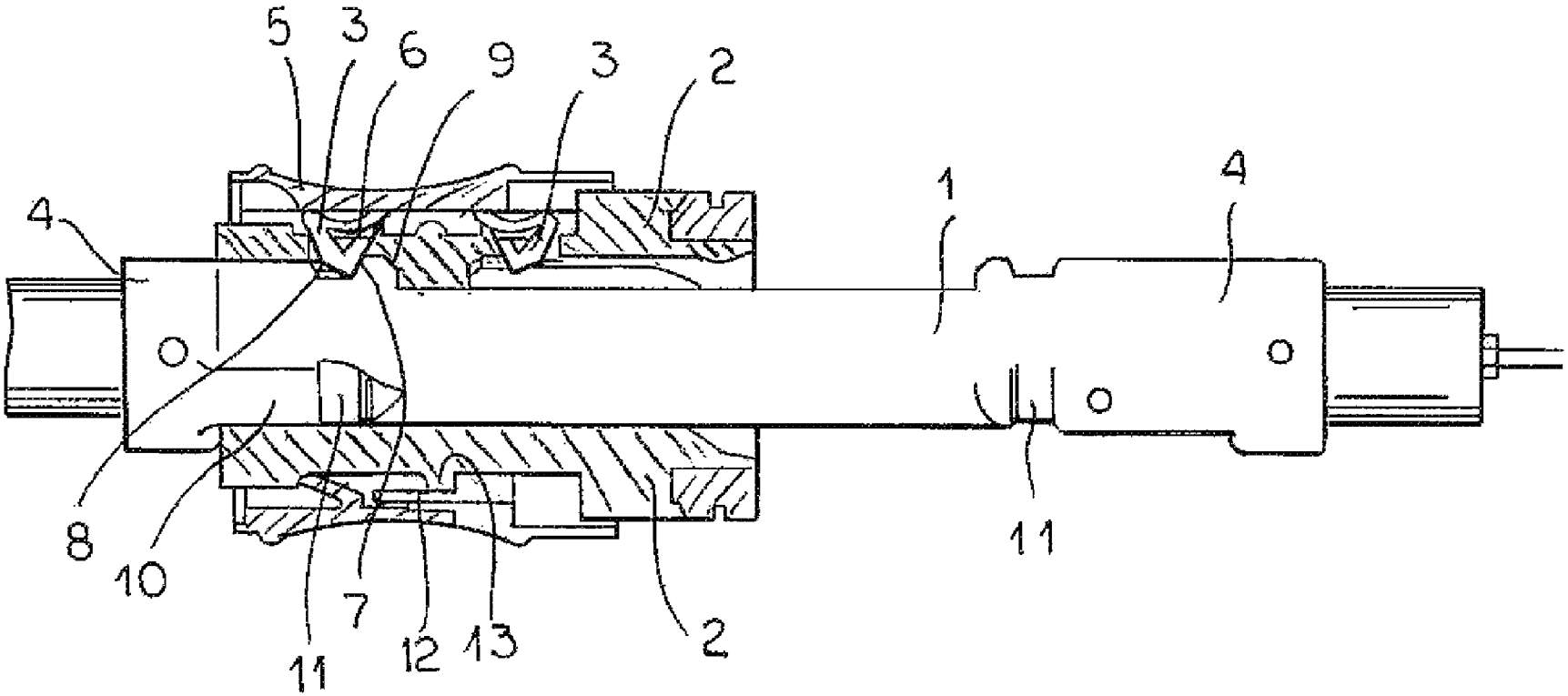
FIGS. 1A and 1B are partly section cut-away longitudinal sections of the umbrella actuator according to the invention in its end positions with the rest of the umbrella shown schematically in smaller scale.
Figure 1B:
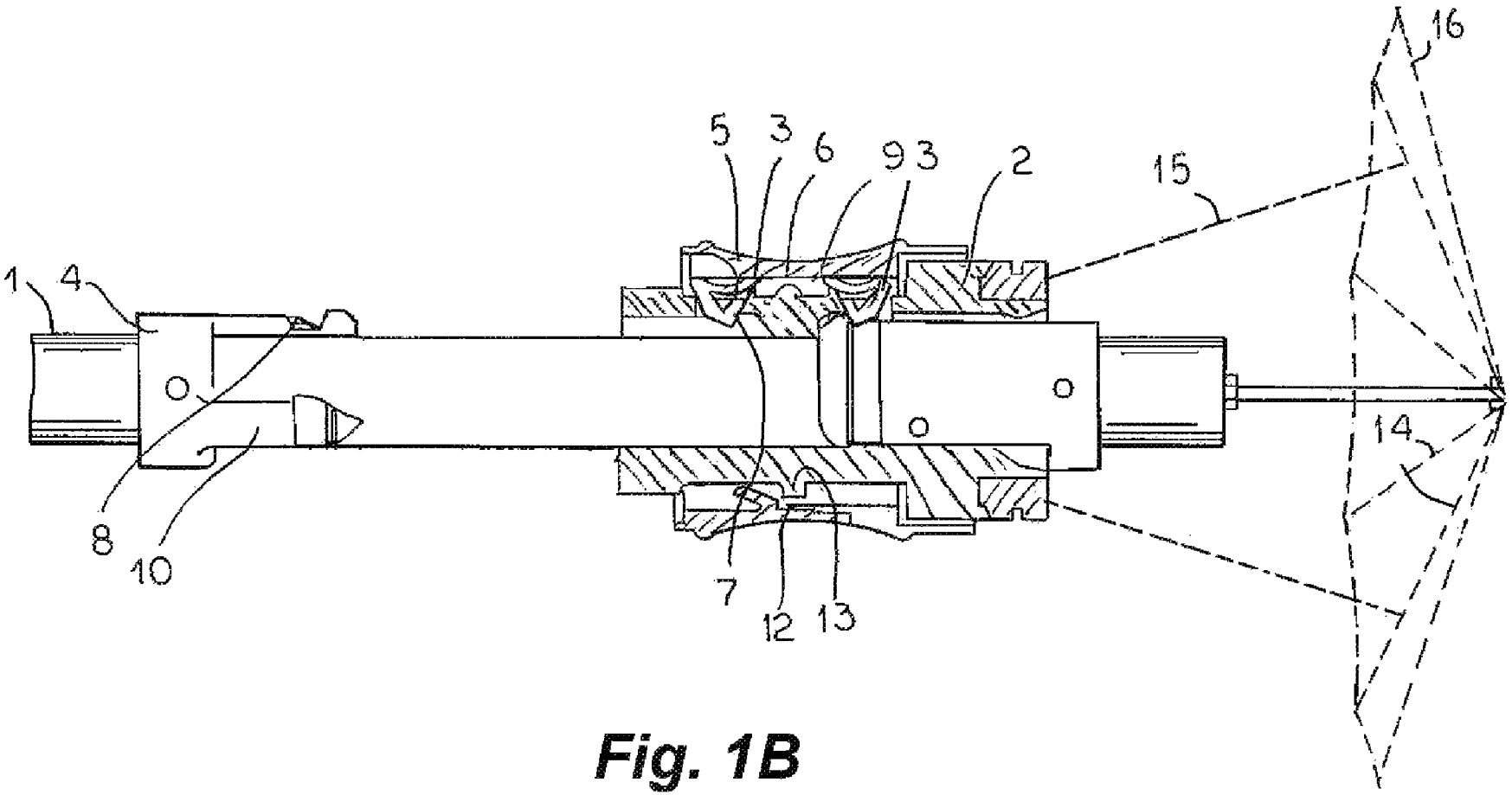
Figure 2:
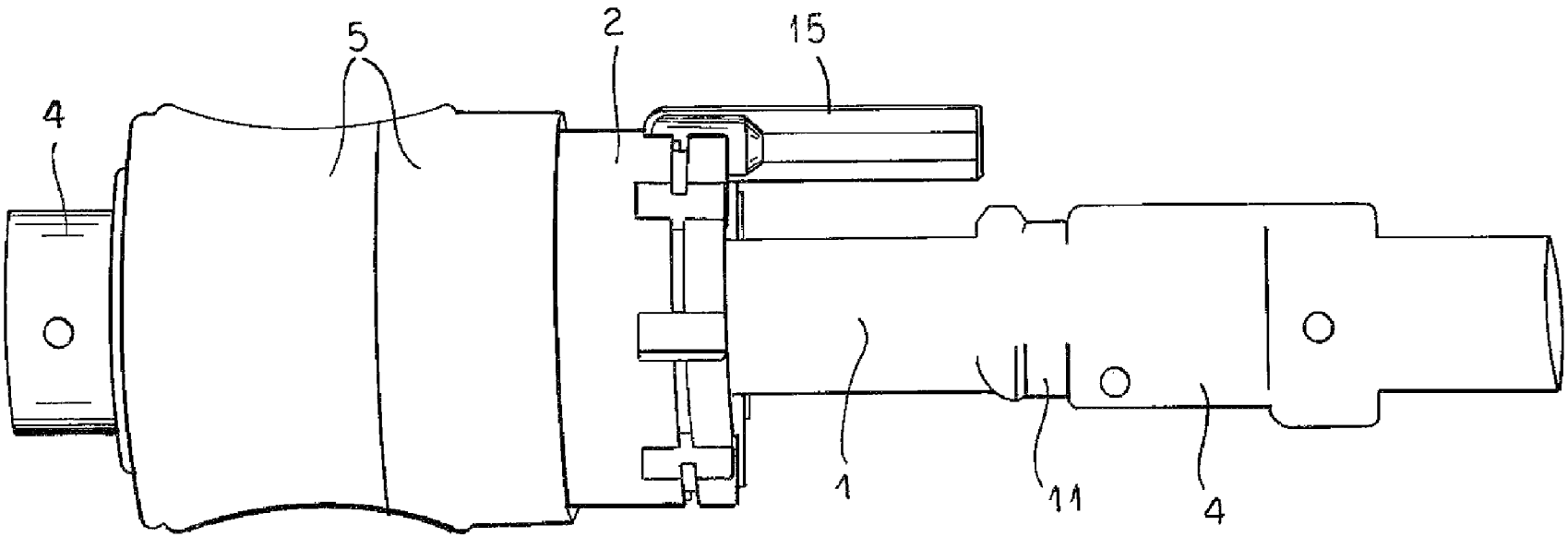
FIG. 2 is a top view of the umbrella according to FIG. 1.

The umbrella, illustrated only partially in FIG. 1 with the components necessary for explaining the invention, is formed by an umbrella shaft 1 and an umbrella frame situated on the umbrella shaft 1, the frame comprising a spider that is formed by umbrella ribs 14 supporting a canopy 16 (FIG. 1B), and spreader struts 15 that are pivoted on the umbrella ribs 14 and on a slider 2 that is supported so as to be longitudinally displaceable on the umbrella shaft 1 between a closed position (FIG. 1A) and an open position (FIG. 1B) of the umbrella frame. The slider 2 has six locking elements 3 of which three can engage in each of two lock seats 4 associated with the umbrella shaft in end positions of the slider 2. A handle 5 is provided on the slider 2 that can axially shift the slider 2 between the two end positions. This handle 5 is forcibly entrained from one end position to the other when the slider 2 is actuated, and the locking elements 3 that are in the engaged state are shifted to an unlocked state, and the other locking elements 3 are shifted to a locked state that allows engagement in the other lock seat 4. The locking elements 3 each have a first surface 6 that is inclined relative to the longitudinal axis of the umbrella shaft 1 and engages against a surface 7 of the lock seat 4 when the slider 2 is actuated and the locking element 3 is in the engaged position and in the unlocked state, so that the locking element 3 may be moved from the engaged position by radial displacement relative to the umbrella axis.

The locking element 3 has a second surface 8 that is inclined relative to the longitudinal axis of the umbrella shaft 1 and engages against a surface 9 of the lock seat 4 as the slider 2 approaches the respective lock seat 4, so that an elastic deformation of the locking elements 3 in the locked state directed radially outward relative to the longitudinal axis of the umbrella shaft 1, followed by elastic rebound, allows the locking elements 3 to engage in the lock seat 4. The lock seat is formed by a locking sleeve coaxially fixedly mounted on the umbrella shaft 1, in the illustrated embodiment illustrated here the lock seat having three finger-shaped longitudinal sections 10, each having a transverse groove 11, resting against the umbrella shaft 1 and extending parallel to the longitudinal axis thereof. The handle 5 is designed as a sleeve that is coaxially nonrotatably mounted on the slider 2, and has a shoulder that is brought into contact with a shoulder formed by the slider 2 when the handle 5 reaches the end position of its travel. A locking member 12 is provided for detachably securing the handle 5 in its particular end position. In the embodiment illustrated here, the locking member is designed as an offset and elastically deformable tongue situated on the side of the handle 5 facing the slider 2. The offset area and the end face of the tongue are provided for resting against a catch 13 situated on the outer peripheral surface of the slider 2. To prevent the handle 5 from being pulled off the slider 2 an additional locking tongue is provided on the side of the handle 5 facing the slider. The slider 2 has skids on the side facing the umbrella shaft 1, and may be displaced over the locking sleeves. The handle 5 has a multipart design to simplify manufacture and installation on the slider 2.

The operation of the umbrella is briefly described below:

To open the umbrella, the handle 5 that covers the slider 2 in the manner of a sleeve is gripped, and the slider 2 is moved in the direction of the open position of the umbrella frame. The handle 5 is first shifted from one end position to the other end position, and the locking elements 3 that are in engagement are shifted to an unlocked state, whereas the other locking elements 3 are shifted to a locked state that allows engagement in the other lock seat 4. The axial displacement of the slider 2 causes the locking elements 3, each having a first surface 6 inclined relative to the longitudinal axis of the umbrella shaft 1, to be guided against a surface 7 of the lock seat 4, thus allowing the locking elements 3 to be moved radially relative to the umbrella axis from the engaged position, and enabling the slider 2 to then move unhindered to the open position of the umbrella. As the slider 2 approaches the other lock seat 4 the locking elements having a second surface 8 inclined relative to the longitudinal axis of the umbrella shaft 1 are each guided against a surface 9 of the lock seat 4, so that elastic deformation of the locking elements 3 directed radially outward relative to the longitudinal axis of the umbrella shaft 1, followed by elastic rebound, allows the locking elements 3 to engage in the lock seat 4. The slider 2 is thus locked in the open position of the umbrella frame. The procedure is repeated in an analogous manner to close the umbrella.

The invention claimed is:

1. An umbrella comprising:

a shaft;

a pair of spaced locking sleeves fixed to the shaft and each having at least one longitudinally extending finger lying against the shaft and formed with a transverse groove in turn forming a respective lock seat;

an array of ribs pivotal on the shaft between an open position projecting outward from the shaft and a closed position extending along the shaft;

a canopy spanned over the ribs;

a slider shiftable on the shaft between a pair of end positions each juxtaposed with a respective one of the seats lock;

spreader struts engaged between the slider and the ribs for shifting the ribs and canopy into the open position in one of the end positions of the slider and into the closed position in the other end position of the slider;

at least two locking elements on the slider; and a handle shiftable on the slider on movement of the slider into the one end position into engagement with one of the locking elements to push the one locking element into engagement with one of the seats and on movement of the slider into the other end position to push the other locking element into engagement with the other of the seats.

2. The umbrella according to claim 1, wherein each locking element has a first surface that is inclined relative to a longitudinal axis of the umbrella shaft and that engages against a surface of the respective lock seat when the slider is actuated and the locking element is in the engaged position and in the unlocked state, thus allowing the locking element to be moved from the engaged position by radial displacement relative to the umbrella axis.

3. The umbrella according to claim 2, wherein the locking element has a second surface that is inclined relative to the longitudinal axis of the umbrella shaft and that engages against a surface of the lock seat as the slider approaches the respective lock seat, so that an elastic deformation of the locking element in the locked state directed radially outward relative to the longitudinal axis of the umbrella shaft, followed by elastic rebound, allows the locking element to engage in the lock seat.

4. The umbrella according to claim 1, wherein each locking sleeve has three such fingers uniformly spaced on the umbrella shaft, and the slider has six locking elements of which three are each associated with a respective one of the locking sleeves, and by use of the handle may all be shifted to the locked or unlocked state.

5. The umbrella according to claim 1, wherein the handle is a sleeve that is coaxially nonrotatably mounted on the slider.

6. The umbrella according to claim 1, wherein the handle has at least one shoulder that is brought into contact with a shoulder formed by the slider when the handle reaches each end position of the displacement motion.

7. The umbrella according to claim 1, wherein at least one locking member is provided for detachably securing the handle in its respective end position, and the handle is protected from being pulled off from the slider.

8. The umbrella according to claim 7, wherein the locking member is an offset and elastically deformable tongue situated on the side of the handle facing the slider, an offset end face of the tongue resting against a catch situated on the outer peripheral surface of the slider.

9. The umbrella according to claim 1, wherein the slider has skids on the side facing the umbrella shaft, and displacement of the slider over the locking seat is enabled.

10. The umbrella according to claim 1, wherein the handle has a multipart design.

* * * * *